US012085370B2

(12) United States Patent
Suvilahti et al.

(10) Patent No.: US 12,085,370 B2
(45) Date of Patent: Sep. 10, 2024

(54) BULLET

(71) Applicant: Sako Oy, Riihimäki (FI)

(72) Inventors: Aki Suvilahti, Espoo (FI); Lasse Levula, Riihimäki (FI); Petteri Roivas, Tampere (FI); Aleksi Mannila, Helsinki (FI); Jarno Taupila, Hyvinkää (FI)

(73) Assignee: Sako Oy, Riihimäki (FI)

( * ) Notice: Subject to any disclaimer, the term of this patent is extended or adjusted under 35 U.S.C. 154(b) by 24 days.

(21) Appl. No.: 17/801,789

(22) PCT Filed: Jan. 27, 2021

(86) PCT No.: PCT/FI2021/050050
§ 371 (c)(1),
(2) Date: Aug. 23, 2022

(87) PCT Pub. No.: WO2021/170899
PCT Pub. Date: Sep. 2, 2021

(65) Prior Publication Data

US 2023/0093842 A1 Mar. 30, 2023

(30) Foreign Application Priority Data

Feb. 28, 2020 (FI) ..... 20205207

(51) Int. Cl.
*F42B 12/74* (2006.01)
*F42B 12/34* (2006.01)

(52) U.S. Cl.
CPC ..... *F42B 12/74* (2013.01); *F42B 12/34* (2013.01)

(58) Field of Classification Search
CPC ..... F42B 12/74; F42B 12/34
(Continued)

(56) References Cited

U.S. PATENT DOCUMENTS 4,044,685 A * 8/1977 Avcin ..... F42B 12/34 102/508
4,108,074 A * 8/1978 Billing, Jr. ..... F42B 8/14 264/328.12

(Continued)

FOREIGN PATENT DOCUMENTS

DE 2820530 A1 11/1979
DE 102112015475 A1 2/2013

(Continued)

OTHER PUBLICATIONS

International Search Report and Written Opinion, in connection with International Application No. PCT/FI2021/050050, dated Apr. 8, 2021.

(Continued)

*Primary Examiner* — Samir Abdosh
(74) *Attorney, Agent, or Firm* — Meunier Carlin & Curfman LLC

(57) ABSTRACT

The invention relates to a bullet, which comprises a bullet body and a bullet tip, which bullet body of the bullet is a solid body bullet body and made of lead-free metal, advantageously of copper, most advantageously extremely pure copper, which bullet tip of the bullet is made of polymer material, advantageously of POM (polyoxymethylene). The bullet body of the bullet comprises an inner central opening with inner grooves located radially spaced apart at the circumference of the inner central opening. The bullet tip of the bullet comprises a tip end part, tip end grooves and a tip end central bridge, and the bullet tip is located in the inner central opening of the bullet body such, that the tip end part of the bullet tip is outside the bullet body.

18 Claims, 4 Drawing Sheets

(58) Field of Classification Search
USPC ..... 102/507
See application file for complete search history.

(56) References Cited

U.S. PATENT DOCUMENTS

| | | | | |
|---|---|---|---|---|
| 4,685,937 | A | 8/1987 | Schirneker et al. | |
| 7,299,750 | B2 * | 11/2007 | Schikora | F42B 12/34 102/508 |
| 8,186,277 | B1 | 5/2012 | King | |
| 10,352,669 | B2 | 7/2019 | Fournier et al. | |
| 2012/0111220 | A1 * | 5/2012 | King | F42B 12/34 102/509 |
| 2014/0202351 | A1 * | 7/2014 | Muskat | F42B 12/74 102/517 |
| 2018/0094911 | A1 * | 4/2018 | Fournier | F42B 12/34 |
| 2019/0249964 | A1 * | 8/2019 | Stock, Jr. | F42B 12/34 |
| 2020/0256656 | A1 * | 8/2020 | Thielen | F42B 10/46 |
| 2023/0093842 | A1 * | 3/2023 | Suvilahti | F42B 12/74 102/507 |

FOREIGN PATENT DOCUMENTS

| | | | |
|---|---|---|---|
| EP | 1355119 | A1 | 10/2003 |
| EP | 2965038 | | 1/2016 |
| WO | 2018136338 | A2 | 7/2019 |

OTHER PUBLICATIONS

Search report of Finnish Patent and Registration Office, in connection with Finnish application No. FI20205207, dated Sep. 9, 2020, 2 pages.

* cited by examiner

BULLET

TECHNICAL FIELD

The present invention relates to bullets for hunting. In particular, the present invention relates to a bullet according to the preamble of claim 1.

BACKGROUND

Different kinds of hunting bullets are known from prior art.

In patent publication EP2965038 is disclosed a bullet comprising a body made of solid-material metal and having on its nose and in the center axis thereof a cavity comprising at least two consecutive cavity parts. The diameter of the nose of the bullet is arranged to mushroom under the effect of a pressure directed to it as it hits its target. In the direction away from the nose, the diameter of each cavity part is smaller than the preceding one in such a manner that the consecutive cavity parts are formed in such a manner that in the direction away from the nose, the diameter of the next cavity part is clearly smaller than the diameter of the preceding cavity part, thus forming a step-shaped discontinuity area, and the consecutive cavity parts are of a length, in which the length of the cavity part on the nose side is clearly longer than the length of the next cavity part. When mushrooming, the diameter of the bullet nose is adapted to reach a size that is at most 1.2× the diameter of the bullet body, and to produce a shape for the nose that is slightly concave or substantially blunt-shaped.

In patent application publication EP1355119 is disclosed a bullet comprising a substantially cylindrical body and a substantially conically convergent point, from which point a cavity filled at least partly with a filling agent is arranged to extend towards the base of the bullet. The cavity is, when penetrating the point of the bullet, arranged to form a sealing surface on it. The sealing surface comprises a surface positioned at least partly at an angle in relation to the longitudinal axis of the bullet to form a substantially conical surface descending to the cavity in such a manner that the filling agent in the cavity is arranged to extend over substantially the entire sealing surface up till an outer jacket of the bullet.

In patent publication U.S. Ser. No. 10/352,669 is disclosed a projectile, which comprises a projectile body comprising a nose portion, a tail portion, a base, a bearing surface, and a groove cut into the bearing surface, wherein the portion of the projectile between the bearing surface and the groove comprises a curved first transition portion, wherein the curved first transition portion is convex from the bearing surface to the groove relative to a longitudinal axis defined by the center of the nose portion and the center of the base, wherein the curved first transition portion is tangential to the bearing surface, and wherein the curved first transition portion is defined by the von Karman equation.

In patent publication U.S. Pat. No. 7,299,750 is disclosed a set of jacketless cored bullets, including both a partly fragmenting bullet and a deformable bullet, comprising a deformable bullet having a bullet tip and a bullet tail, and having an enclosed cavity within the bullet tip, the enclosed cavity being closed by a cap, the deformable bullet comprising a base alloy of copper and zinc; and a partly fragmenting bullet having a bullet tip and a bullet tail, and having an enclosed cavity within the bullet tip, the enclosed cavity being closed by a cap, the partly fragmenting bullet comprising a base alloy of copper and zinc; wherein the partly fragmenting bullet has an impact point position, a caliber, an external volume, a mass, and a center of gravity substantially identical to that of the deformable bullet, but wherein the enclosed cavity of the partly fragmenting bullet is larger relative to the enclosed cavity of the deformable bullet by an additional portion and wherein a mass loss caused by the larger enclosed cavity of the partly fragmenting bullet is compensated by a change in relative proportions of copper and zinc In the base alloy and/or by an addition of at least one element positively influencing fragmentation at the cost of the copper and zinc of the base alloy.

In patent publication U.S. Pat. No. 8,186,277 is disclosed a bullet comprising a lead-free body having a tail section, a nose section having an ogived outer surface and a forward terminus, an opening at the forward terminus, the opening having a first-cross sectional dimension, and a cavity in the nose section extending rearward from the opening to an intermediate section of the body, wherein the cavity includes a forward sidewall that has at least a generally frusto-conical shape extending from the opening to a second cross-sectional dimension, the forward sidewall converging rearward from the first cross-sectional dimension to the second cross-sectional dimension, and a rear sidewall contiguous with the forward sidewall and extending directly from the second cross-sectional dimension to a third cross-sectional dimension, the rear sidewall diverging rearward from the second cross-sectional dimension to the third cross-sectional dimension.

In patent application publication WO2018136338 is disclosed an expanding projectile comprising: a projectile body including a metal jacket extending from a tail portion to a nose portion and surrounding an interior solid core, the metal jacket tapered at the nose portion in a forward direction to an annular forward edge, the annular forward edge defining an opening in the metal jacket to an interior cavity extending from the opening in a rearward direction to a forward facing interior surface of the interior solid core; a tip portion mounted in the interior cavity and having an exterior surface substantially flush with an exterior surface of the metal jacket, the tip portion having a main portion forward of the opening and a tip retention portion at least partially filling the interior cavity, the tip retention portion including one or more fracture regions configured to, upon impact of the expanding projectile with a target, fracture or deform to expose one or more fluid pathways into the interior cavity and to the forward facing interior surface for initiating expansion of the expanding projectile.

In patent application publication US2019249964 is disclosed a bullet comprising: a jacket, the jacket being generally cup-shaped with a closed rear end, an open front end, a generally cylindrical sidewall between the rear end and the front end with an inwardly tapering lip adjacent the front end; a core disposed inside the jacket, the core having a plurality of slits formed therein; and a tip, having a forwardly facing ogival surface tapering to a forward end, a rearwardly facing surface tapering to a shank embedded in the core, and a rearwardly facing shoulder abutting the front end of the jacket forming a smooth transition therewith, and a plurality of notches formed in the forwardly facing ogival surface; each notch having a forward end adjacent the forward end of the tip, and a rear end rearward of the rearwardly facing shoulder and the front end of the jacket.

SUMMARY

An objective of the invention is to create a bullet for hunting, in which the disadvantages and problems of the arrangements according to prior art eliminated or at least minimized.

An objective of the invention is to create an improved bullet for hunting, which provides improved muzzle velocities.

Another objective of the invention is to create an improved bullet for hunting, in which improved expandability is achieved.

Yet, another object of the invention is to create an improved bullet for hunting, which provide homogenous penetration of tissue of game irrespective of impact velocity.

In particular, an object of the invention is also to create a bullet for hunting, which can be manufactured cost-effectively.

In order to achieve the above objects and those described later the bullet according to the invention is mainly characterized by the features of claim 1. In the dependent claims additional advantageous features and aspects of the invention are defined.

The bullet described herein may be employed in hunting of different game animals.

According to the invention the bullet comprises a bullet body and a bullet tip, which bullet body of the bullet is a solid body bullet body and made of lead-free metal, advantageously of copper, most advantageously extremely pure copper, which bullet tip of the bullet is made of polymer material, advantageously of POM (polyoxymethylene), wherein the bullet body of the bullet comprises an inner central opening with inner grooves located radially spaced apart at the circumference of the inner central opening, the bullet tip of the bullet comprises a tip end part, tip end grooves and a tip end central bridge, and the bullet tip is located in the inner central opening of the bullet body such, that the tip end part of the bullet tip is outside the bullet body.

According to an advantageous feature of the invention the bullet tip of the bullet is manufactured by injection moulding technique.

According to the invention the inner grooves extend a distance in the bullet body, which distance is shorter than the depth of the central opening, advantageously the distance is about three times the diameter of the central opening.

According to the invention the inner grooves have advantageously a tapered-like cross section with a rounded end and that the tapering angle is advantageously 40-50° and the roundup is advantageously 0.1-0.3 mm.

According to an advantageous feature of the invention the tip end central bridge and the tip end grooves are inclined in view of the center axis line of the bullet tip and that advantageously the inclination angle is 2-2.5°.

According to an advantageous feature of the invention between upper ends of the tip end grooves and outermost surface of the bullet tip has roundups forming ridges, that the roundup is advantageously 0.1-0.3 mm, more advantageously about 0.2 mm and that the ridges are advantageously of height 0.15-0.2 mm, more advantageously about 0.17 mm.

According to an advantageous feature of the invention the bullet tip comprises the tip end part, a cylindrical mid part and a tapered, inner end part and that the tapered tip end part is configured to end to a shoulder part.

According to an advantageous feature of the invention the bullet body has a tapered part at the tip end and a substantially cylindrical part forming the other end.

According to an advantageous feature of the invention the common length of the cylindrical middle part of the bullet tip and the tapered bottom end part is less than the depth of the inner central opening of the bullet body.

According to an advantageous feature of the invention the bullet tip is located in the inner central opening of the bullet body such, that the shoulder part of the bullet tip is set against the outermost tip end surface of the bullet body.

According to an advantageous feature of the invention that the tip end grooves have a functional length of 2.1 mm-2.15 mm, advantageously about 2.12 mm and that the end of the tip end grooves is rounded to radius, which is advantageously 1.0-1.4 mm, more advantageously about 1.2 mm.

According to an advantageous feature of the invention height of the shoulder is 3.1-1.5 mm, advantageously about 3.35 mm.

According to an advantageous feature of the invention the bullet body comprises five inner grooves and they are located spaced apart at uniform interval.

According to an advantageous feature of the invention the bullet tip comprises three or four tip end grooves and they are located spaced apart at uniform interval.

According to an advantageous feature of the invention the area of cross sections of the inner grooves is about 17.5% of area of cross section of the central opening.

According to an advantageous aspect of the invention the bullet comprises a relief bevelling that provides for high muzzle velocities. This also provides for cost-effective manufacturing as more effective tools can be used and higher cutting speeds can be achieved.

According to an advantageous aspect of the invention the bullet comprises inner grooves around an inner central opening, which speeds up opening of the bullet. By dimensioning the inner grooves in high velocity tissue impact the bullet expands rapidly to greater diameter and in low velocity along whole length of the grooves. Thus, homogenous penetrations of tissue of game is achieved as well as on average higher impact energy such that penetration through a game animal causes a through hole and faster loss of consciousness is contributed.

According to an advantageous aspect of the invention the bullet comprises a bullet tip, which has a structure that provides for low air resistance. The bullet tip is well air penetrable and mechanically strong.

According to an advantageous aspect of the invention the bullet comprises a bullet tip with inclined grooving in view of on average rotational velocity of the bullet and of relative direction of air flow such that no additional rotational declination, decrease of rotational velocity nor air resistance is caused.

According to an advantageous aspect of the invention the bullet comprises a bullet tip comprising grooving that increases deformation velocity of the bullet tip, which provides for stronger and faster opening impact from the bullet tip to the bullet body and thus, the bullet expands more rapidly and with lower impact velocities.

According to an advantageous aspect of the invention the bullet comprises a bullet tip with cutting effect, which increases the likelihood of hair unfastening from the hit point, which might be of help in situation after the shot in case the game animal has not immediately been captured.

By the invention and its advantageous features several advantages are achieved: improved, higher muzzle velocities, improved expandability, homogenous penetration of tissue of game irrespective of impact velocity and cost-effective manufacturing of the bullet.

The exemplifying embodiments of the invention presented in this patent application are not to be interpreted to pose limitations to the applicability of the appended claims. The verb "to comprise" and its derivatives are used in this patent application as an open limitation that does not exclude the existence of also unrecited features. The features described hereinafter are mutually freely combinable unless explicitly stated otherwise.

BRIEF DESCRIPTION OF THE DRAWINGS

Aspects of the invention, however, together with additional objects and advantages thereof, will be best understood from the following description of some example embodiments when read in connection with the accompanying drawings and in the following the invention is described in more detail referring to the accompanying drawing, in which.

DETAILED DESCRIPTION

During the course of the following description like numbers and signs will be used to identify like elements according to the different views which illustrate the invention and its advantageous examples. In the figures some repetitive reference signs may have been omitted for clarity reasons.

Figure 1:
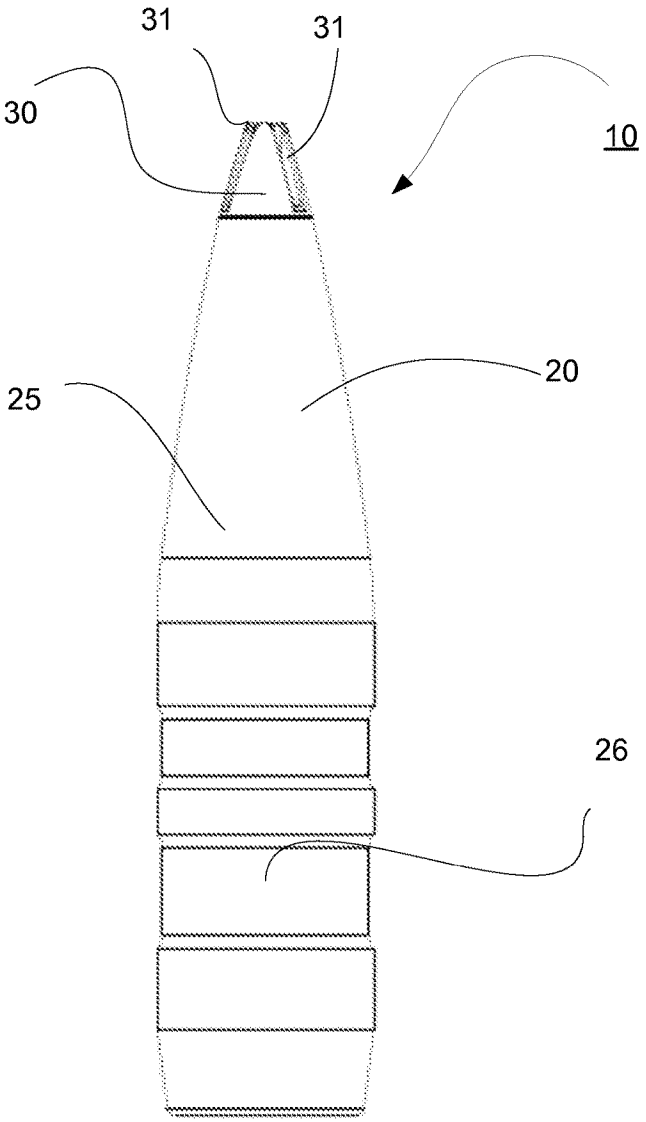
FIG. 1 is schematically shown as a side view an advantageous example of a bullet according to the invention.
Figure 2:
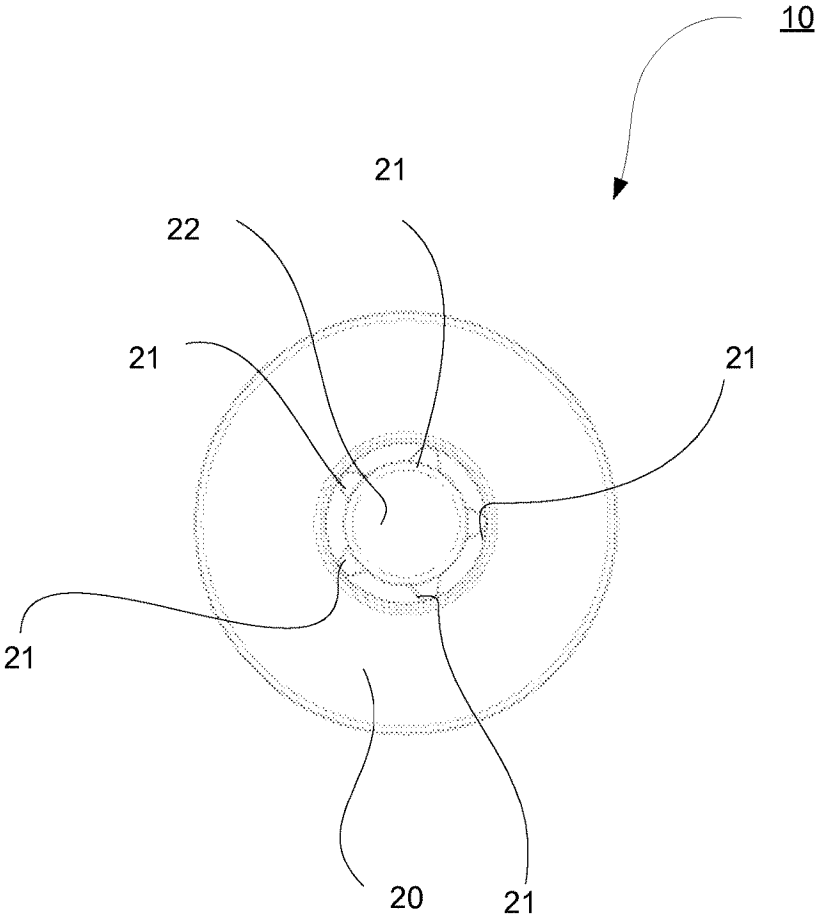
FIG. 2 is schematically shown as an end view the advantageous example of the bullet body of the bullet without a tip end according to FIG. 1.
Figure 5:
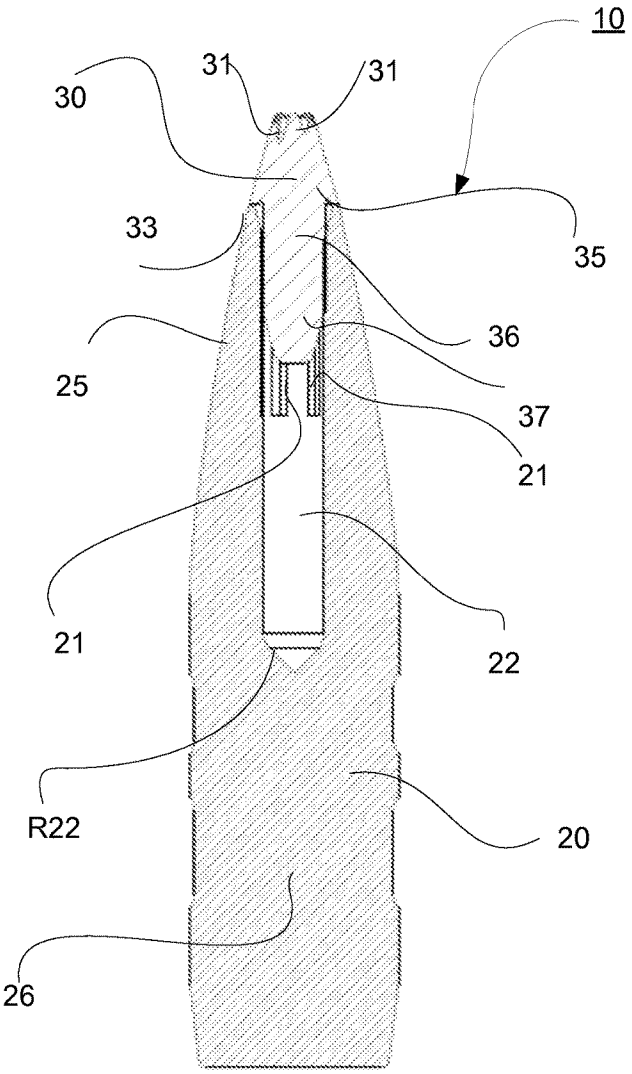
FIG. 5 is schematically shown as a cut view the advantageous example of the bullet according to the FIGS. 1-4.
Figure 4:
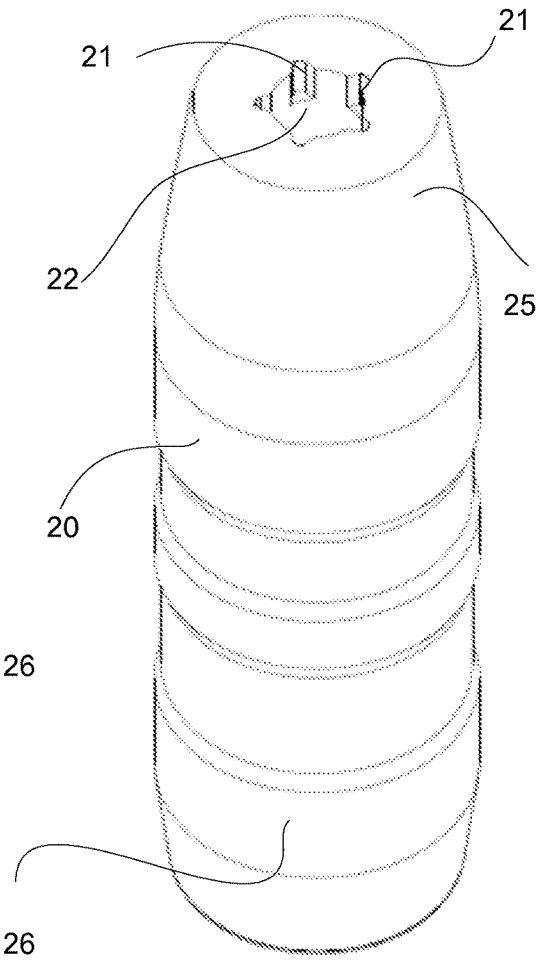
FIG. 4 is schematically shown as a tip end partially cut-view with lower cut than in the FIG. 3 the advantageous example of the bullet body according to FIG. 3 of the advantageous example of the bullet according to FIGS. 1-2.
Figure 3:
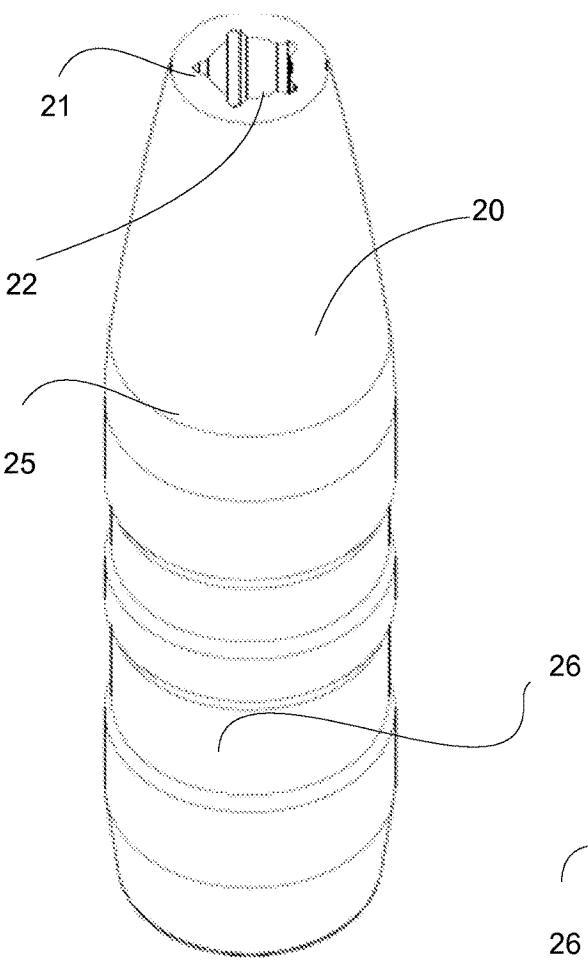
FIG. 3 is schematically shown as a tip end partially cut-view an advantageous example of a bullet body of the bullet according to FIGS. 1-2.
Figure 7:
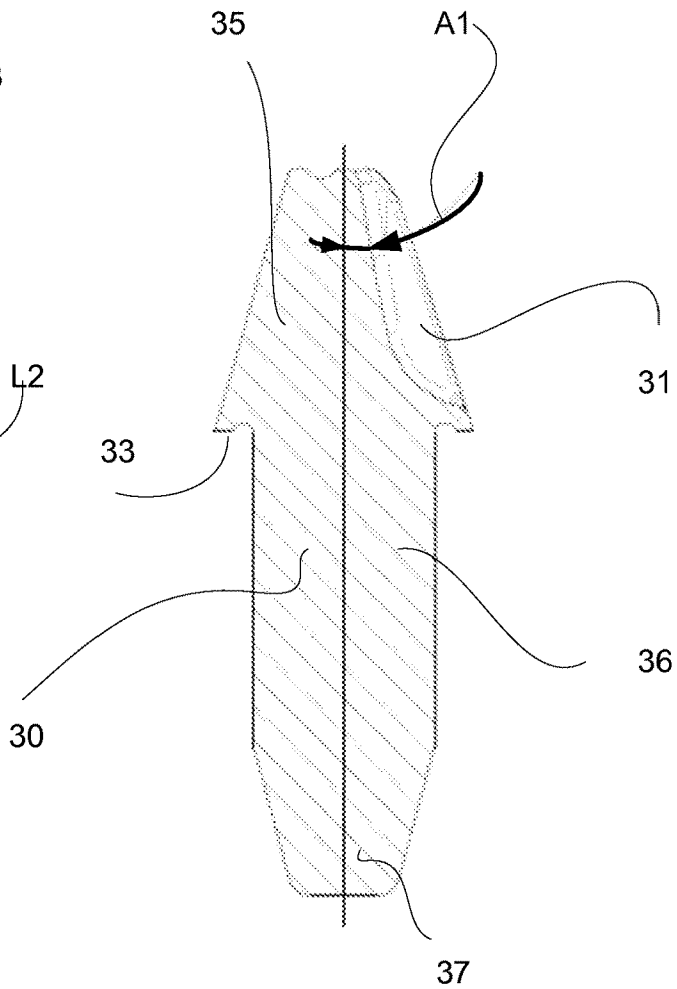
FIG. 7 is schematically shown as a cut view the advantageous example of a bullet tip of the advantageous example of the bullet according to FIGS. 1-6.
Figure 6:
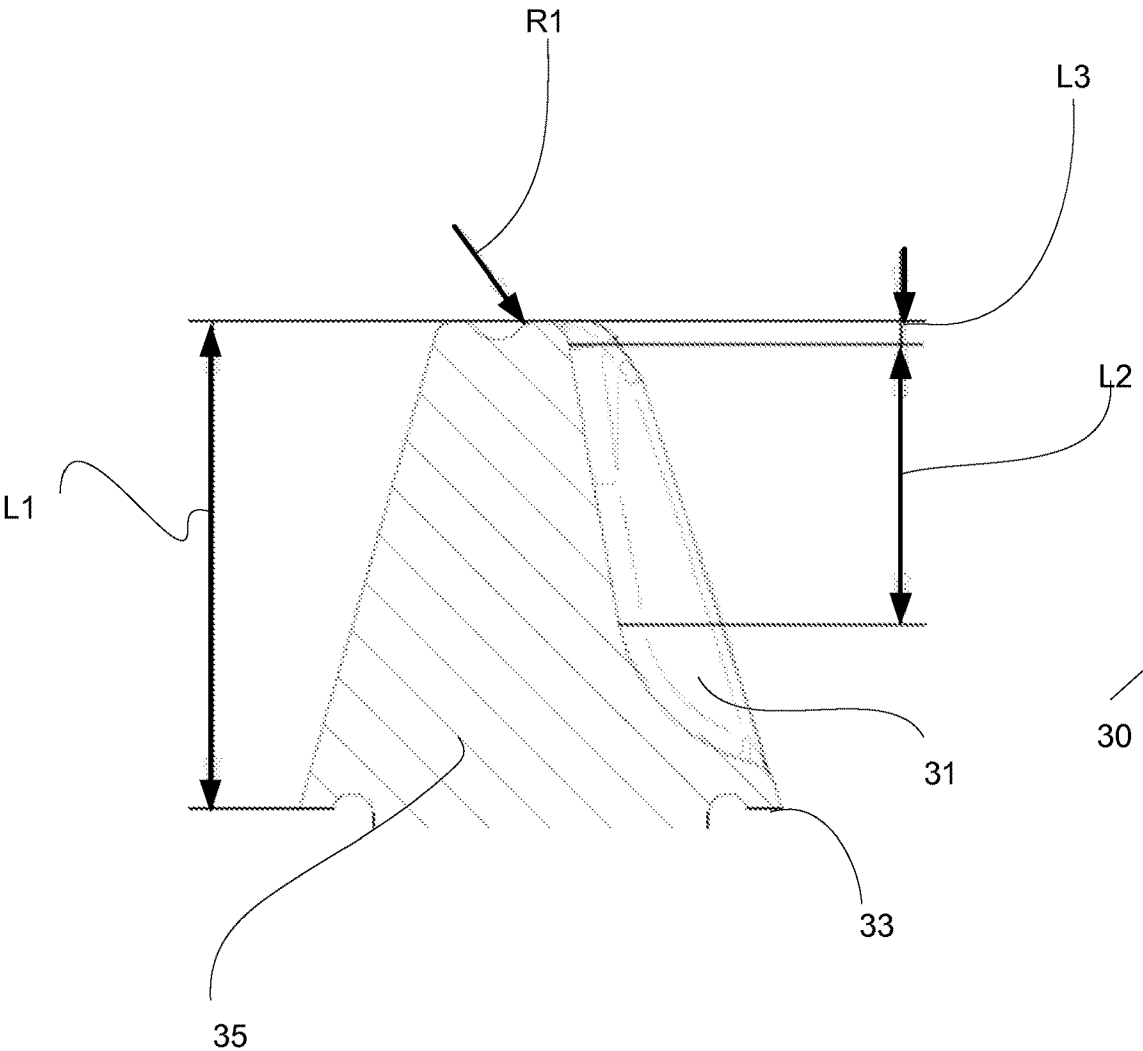
FIG. 6 is schematically shown as a partial cut view an advantageous example of a bullet tip of the advantageous example of the bullet according to FIGS. 1-5.
Figure 9:
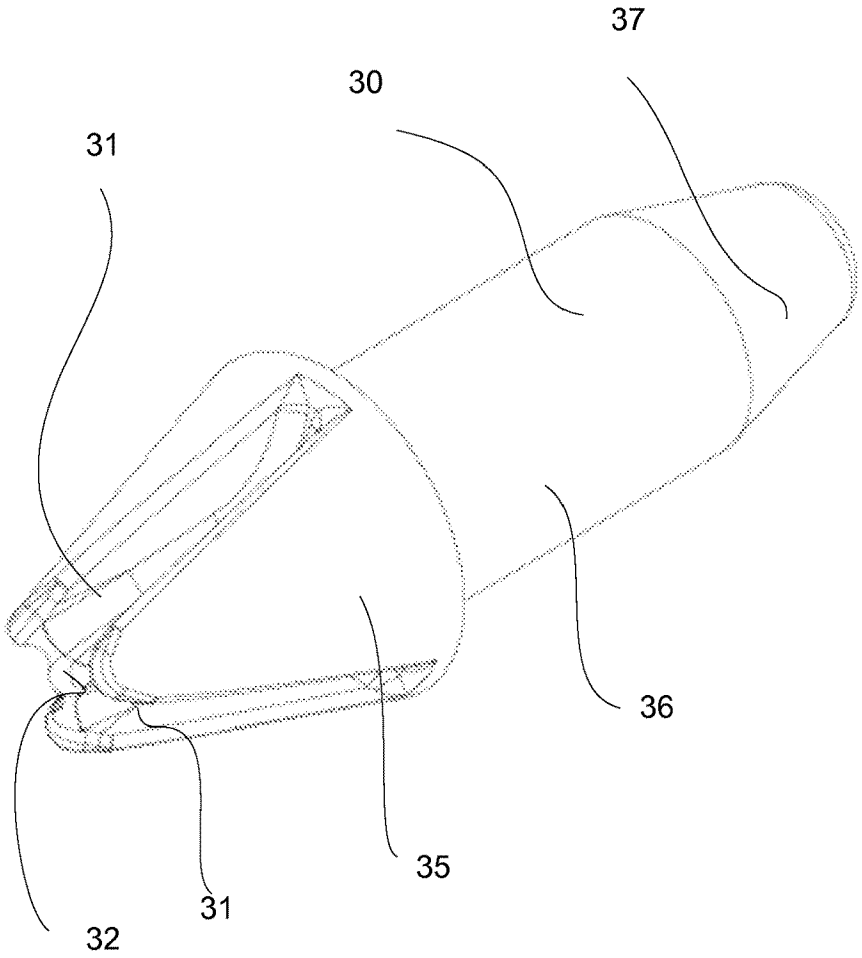
FIG. 8 is schematically shown as a cut view the advantageous example of a bullet tip of the advantageous example of the bullet according to FIGS. 1-7 and FIG. 9 is schematically shown as a three-dimensional view the advantageous example of a bullet tip of the advantageous example of the bullet according to FIGS. 1-8.
Figure 8:
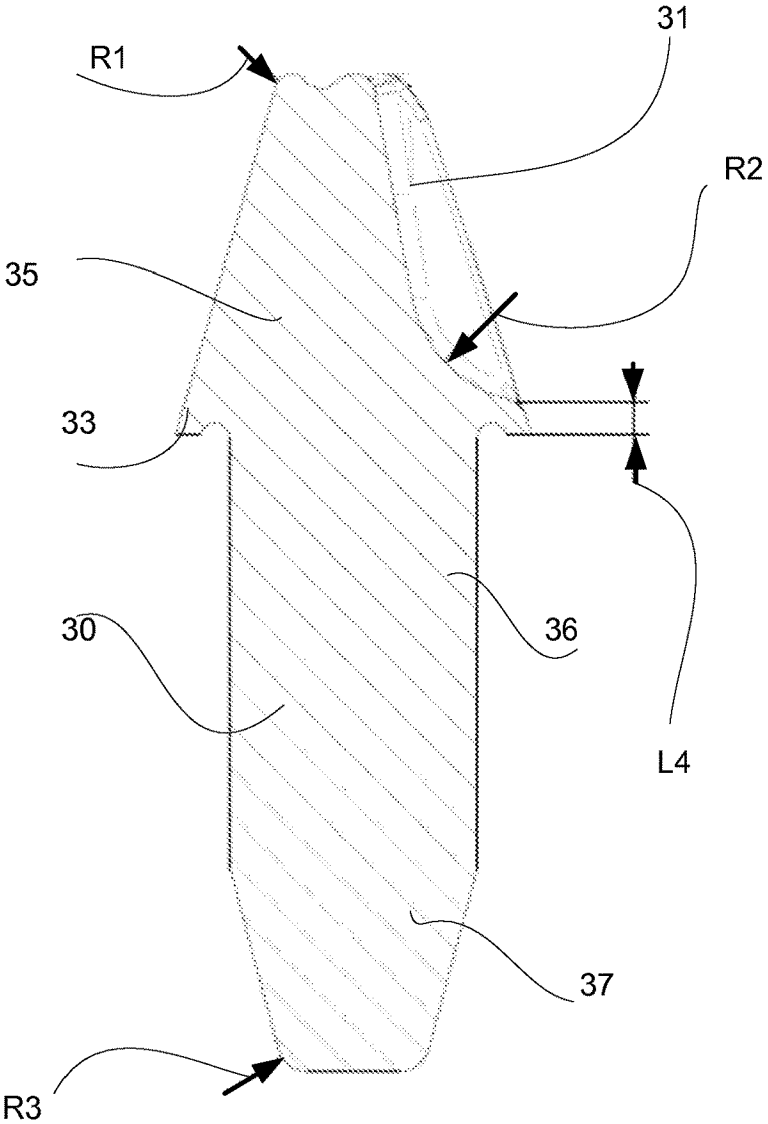

In the FIGS. 1-9 is shown a bullet 10 in accordance with an advantageous example of the invention. The bullet 10 comprises a bullet body 20 and a bullet tip 30. The bullet body 20 is a solid body bullet body and made of lead-free metal, advantageously of copper, most advantageously extremely pure copper, which has high toughness, bending capacity and elongation, for example Cu CW008A. The bullet tip 30 is made of polymer material, advantageously of POM (polyoxymethylene). The bullet tip 30 is advantageously manufactured by injection molding technique.

The bullet body 20 comprises an inner central opening 22 with inner grooves 21, which are located radially spaced apart at the circumference of the inner central opening 22. The inner grooves 21 extend a distance in the bullet body 20, which distance is shorter than the depth of the central opening 22, advantageously the distance is about three times the diameter of the central opening 22. The diameter of the central opening 22 is advantageously 1-3 mm, more advantageously 1.8-2.8 mm. The inner grooves 21 have advantageously a tapered-like cross section with a rounded end. The tapering angle is advantageously 40-50° and the roundup is advantageously 0.1-0.3 mm. Advantageously, the bullet body comprises five inner grooves 21 and they are located spaced apart at uniform interval. The bullet body 20 has a tapered part at the tip end 25 and a substantially cylindrical part 26 forming the other end. Area of the cross section of one inner groove is advantageously 0,145 $mm^2$ and area of the dross section of the central opening 22 is advantageously 4,155 $mm^2$. Thus, the area of the cross section of one inner groove 21 is about 3.5% of the area of the cross section of the central opening 22 and the area of the cross sections of the inner grooves 21 about 17.5% of the area of the cross section of the central opening 22. The bottom end of the central opening 22 has a rounding R22, which improves strength of the bullet 10 in higher velocities. The rounding R22 is advantageously 0.6-1.0 mm, more advantageously 0.8 mm.

The bullet tip 30 comprises a tip end part 35, a cylindrical mid part 36 and a tapered, inner end part 37. The bullet tip 30 further comprises tip end grooves 31 and a tip end central bridge 32. The tip end central bridge 32 and the tip end grooves 31 are inclined in view of the center axis line of the bullet tip 30, advantageously the inclination angle A1 is 2-2.5°. The bullet tip 30 advantageously comprises three or four tip end grooves 31 and they are located spaced apart at uniform intervals.

The bullet tip 30 is inserted into the inner central opening 22 of the bullet body 20 such that the tip end part 35 of the bullet tip 30 remains outside the bullet body 20 and forms thus the outer tip of the bullet 10. The bullet tip 30 has the tapered tip end part 35 ending to a shoulder part 33, the cylindrical middle part 36 and to opposite direction than the tip end part 35 tapered bottom end part 37. When the bullet tip 30 is placed into the inner central opening of the bullet body 20 the shoulder part 33 is set against the outermost tip end surface of the bullet body 20. The length L1 of the tapered tip end part 35 from the surface of the shoulder 33 to the outermost upper surface of the tapered tip end part 35 of the tip end 30 is advantageously 3.1-3.7 mm, more advantageously about 3.4 mm. The common length of the cylindrical middle part 36 and the tapered bottom end part 37 is less than the depth of the inner central opening 22 of the bullet body. Between the upper ends of the tip end grooves 31 and the outermost surface of the bullet tip 30 has roundups R1 forming ridges, advantageously the roundup R1 is advantageously 0.1-0.3 mm, more advantageously about 0.2 mm. The ridges are advantageously of height L3 0.15-0.2 mm, more advantageously about 0.17 mm. The tip end grooves 31 have a functional length L2, advantageously 2.1 mm-2.15 mm, more advantageously about 2.12 mm. The end of the tip end grooves 31 is rounded to radius R2, which is advantageously 1.0-1.4 mm, more advantageously about 1.2 mm. The height L4 of the shoulder 33 is advantageously 3.1-1.5 mm, more advantageously about 3.35 mm. The bottom end edge of the bottom end part 37 has advantageously a roundup R3 of 0.1-05 mm, more advantageously about 0.3 mm.

The bullet body 20 of the bullet 10 comprising the inner grooves 21 around the inner central opening 22 speeds up opening of the bullet 10. The dimensioning the inner grooves 22, provides in high velocity tissue impact and the bullet 10 expands rapidly to greater diameter and in low velocity along whole length of the inner grooves 22. Thus, homogenous penetrations of tissue of game is achieved as well as on average higher impact energy such that penetration through a game animal causes a through hole and faster loss of consciousness is contributed.

The bullet tip 30 of the bullet 10 comprising the grooving formed by the tip end grooves 31 and the tip end central bridge 32, which provides a for low air resistance and that the bullet tip 30 is well air penetrable and mechanically strong.

The bullet tip 30 of the bullet 10 comprising the grooving formed by the tip end grooves 31 and the tip end central bridge 32, which in view of on average rotational velocity of the bullet 10 and of relative direction of air flow provides that no additional rotational declination, decrease of rotational velocity nor air resistance is caused.

The bullet tip 30 of the bullet 10 comprising the grooving formed by the tip end grooves 31 and the tip end central bridge 32, which grooving increases deformation velocity of the bullet tip 30, which provides for stronger and faster opening impact from the bullet tip 30 to the bullet body 20 and thus, the bullet 10 expands more rapidly and with lower impact velocities.

The bullet tip 30 of the bullet 10 has cutting effect formed by the tip end grooves 31 and the tip end central bridge 32, which cutting effect of the bullet tip 30 increases the likelihood of hair unfastening from the hit point, which might be of help in situation after the shot in case the game animal has not immediately been captured.

The substantially cylindrical part 26 of the bullet body 20 comprises advantageously a relief bevelling formed around the cylindrical part 26 of the bullet body 20 providing for high muzzle velocities and for cost-effective manufacturing as more effective tools can be used and higher cutting speeds can be achieved. The relief bevelling is formed of various grooves, inclinations and straight parts circumventing the cylindrical part 26 of the bullet body 20. Various configurations of the relief bevelling can be used.

In the description in the foregoing, although some functions have been described with reference to certain features, those functions may be performable by other features whether described or not. Although features have been described with reference to certain embodiments or examples, those features may also be present in other embodiments or examples whether described or not. Above the invention has been described by referring to some advantageous examples only to which the invention is not to be narrowly limited. Many modifications and alterations are possible within the invention as defined in the following claims.

The invention claimed is:

1. A bullet, which comprises a bullet body and a bullet tip, which bullet body of the bullet is a solid body bullet body and made of lead-free metal, which bullet tip of the bullet is made of polymer material, advantageously of POM (polyoxymethylene), which bullet tip of the bullet comprises a tip end part, tip end grooves and a tip end central bridge, wherein the bullet body of the bullet comprises an inner central opening with inner grooves located radially spaced apart at the circumference of the inner central opening, the bullet tip is located in the inner central opening of the bullet body such, that the tip end part of the bullet tip is outside the bullet body, the inner grooves extend a distance in the bullet body, which distance is shorter than the depth of the central opening and the distance is three times the diameter of the central opening, and the inner grooves have a tapered-like cross section with a rounded end and the tapering angle is 40-50° and the roundup is 0.1-0.3 mm.

2. The bullet according to claim 1, wherein the bullet tip of the bullet is manufactured by injection molding technique.

3. The bullet according to claim 1, wherein the tip end central bridge and the tip end grooves are inclined in view of the center axis line of the bullet tip and inclination angle is 2-2.5°.

4. The bullet according to claim 1, wherein between upper ends of the tip end grooves and outermost surface of the bullet tip has roundups forming ridges, and the roundup is 0.1-0.3 mm, and the ridges are of 0.15-0.2 mm of height.

5. The bullet according to claim 1, wherein the bullet tip comprises the tip end part, a cylindrical mid part and a tapered, inner end part and the tapered tip end part is configured to end to a shoulder part.

6. The bullet according to claim 1, wherein the bullet body has a tapered part at the tip end and a substantially cylindrical part forming the other end.

7. The bullet according to claim 5, wherein a common length of the cylindrical middle part of the bullet tip and the tapered bottom end part is less than the depth of the inner central opening of the bullet body.

8. The bullet according to claim 1, wherein the bullet tip is located in the inner central opening of the bullet body such and the shoulder part of the bullet tip is set against the outermost tip end surface of the bullet body.

9. The bullet according to claim 1, wherein the tip end grooves have a functional length of 2.1-2.15 mm, and the end of the tip end grooves is rounded to radius, which is 1.0-1.4 mm.

10. The bullet according to claim 5, wherein height (L4) of the shoulder is 3.35 mm.

11. The bullet according to claim 1, wherein the bullet body comprises five inner grooves spaced apart at uniform interval.

12. The bullet according to claim 1, wherein the bullet tip comprises three or four tip end grooves spaced apart at uniform interval.

13. The bullet according to claim 1, wherein area of cross sections of the inner grooves is 17.5% of area of cross section of the central opening.

14. The bullet according to claim 1, wherein the lead-free metal is copper, most advantageously extremely pure copper.

15. The bullet according to claim 4, wherein the roundup is 0.2 mm.

16. The bullet according to claim 4, wherein the ridges are 0.17 mm of height.

17. The bullet according to claim 9, wherein the functional length of the tip end grooves is 2.12 mm.

18. The bullet according to claim 9, wherein the radius is 1.2 mm.

* * * * *